US008117766B2

(12) United States Patent
Gornatti

(10) Patent No.: US 8,117,766 B2
(45) Date of Patent: Feb. 21, 2012

(54) DEVICE FOR UTILIZATION OF THE ENERGY GENERATED BY BODY WEIGHT

(76) Inventor: Marcelo Ricardo Gornatti, Capital Federal (AR)

( * ) Notice: Subject to any disclaimer, the term of this patent is extended or adjusted under 35 U.S.C. 154(b) by 799 days.

(21) Appl. No.: 12/279,989

(22) PCT Filed: Feb. 23, 2007

(86) PCT No.: PCT/BR2007/000053

§ 371 (c)(1),
(2), (4) Date: Aug. 20, 2008

(87) PCT Pub. No.: WO2008/095266

PCT Pub. Date: Aug. 14, 2008

(65) Prior Publication Data

US 2009/0019726 A1 Jan. 22, 2009

(30) Foreign Application Priority Data

Feb. 9, 2007 (BR) ..... 018070007750

(51) Int. Cl.
*A43B 13/20* (2006.01)

(52) U.S. Cl. ..... 36/29; 36/3 R; 36/35 B

(58) Field of Classification Search ..... 36/3 R, 36/3 B, 28, 29, 35 B

See application file for complete search history.

(56) References Cited

U.S. PATENT DOCUMENTS

| | | | | |
|---|---|---|---|---|
| 4,312,140 | A * | 1/1982 | Reber | 36/3 B |
| 4,358,902 | A * | 11/1982 | Cole et al. | 36/28 |
| 4,414,760 | A * | 11/1983 | Faiella | 36/29 |
| 5,406,719 | A * | 4/1995 | Potter | 36/28 |
| 5,416,986 | A * | 5/1995 | Cole et al. | 36/29 |
| 5,794,361 | A * | 8/1998 | Sadler | 36/29 |
| 5,950,332 | A * | 9/1999 | Lain | 36/3 B |
| 6,085,444 | A * | 7/2000 | Cho | 36/3 B |
| 6,865,825 | B2 * | 3/2005 | Bailey et al. | 36/88 |
| 7,107,706 | B1 * | 9/2006 | Bailey et al. | 36/88 |
| 2003/0101619 | A1 | 6/2003 | Litchfield et al. | |
| 2004/0211085 | A1 | 10/2004 | Passke et al. | |
| 2005/0055846 | A1 * | 3/2005 | Caldwell | 36/29 |
| 2006/0272179 | A1 * | 12/2006 | Passke et al. | 36/3 B |

FOREIGN PATENT DOCUMENTS

| | | |
|---|---|---|
| CA | 2 141 992 | 8/1996 |
| GB | 2 114 425 | 8/1983 |

* cited by examiner

*Primary Examiner* — Marie Patterson
(74) *Attorney, Agent, or Firm* — Defillo & Associates, Inc.; Evelyn A. Defilló

(57) ABSTRACT

The present invention refers to a device for utilization of the energy generated by pressure of body weight on the heal of footwear to be utilized at the moment of the final detachment of the footwear from the ground.

4 Claims, 3 Drawing Sheets

DEVICE FOR UTILIZATION OF THE ENERGY GENERATED BY BODY WEIGHT

CROSS REFERENCE TO RELATED APPLICATION

This application is a national stage entry of PCT/BR2007/000053 filed Feb. 23, 2007, under the International Convention claiming priority over Brazilian application No. 018070007750 filed Feb. 9, 2007.

FIELD OF THE INVENTION

The present invention refers to a device for utilization of the energy generated by pressure of body weight on the heals of footwear to be utilized at the moment of the final detachment of the footwear from the ground.

BACKGROUND OF THE INVENTION

Up to the present date, a great quantity of air chambers located on the sole of footwear are known in the art. Those air chamber are generally located on the back portion of the sole, that is, in the heal, and serve to absorb the shock of the foot against the ground at the moment the user is exercising, be him walking or running. However, the present invention was designed with the objective of utilizing the energy generated by the pressure of the body weight on the heal of the footwear, comprising inside a compression bellows, in order to be utilized through a device comprising valves and a retainer, at the moment of the final detachment of the footwear from the ground by the means of an expansion bellows.

OBJECTIVE OF THE INVENTION

The objective of the present invention is attained by the means of an air (or any other gaseous element) compression bellows within the sole of the footwear, and once the foot is set on it, a pressure is generated and is conducted by a compressed air (or any other gaseous element) retainer, which through an aft retaining valve retains the gas in place, producing, when transmitting the body weight to the front part of the foot, the opening of an aft retaining valve placed on the aft portion of the compressed air (or any gas) retainer, delivering the pressure to the front end of the sole of the footwear producing the expansion of the expansion bellows and, therefore, producing assistance at the time of the detachment of the foot from the ground, releasing, afterwards, the pressure through a flush valve or and exhaust, placed on the front portion of the sole of the footwear. It is important to mention that the invention can be embodied by on or more parallel systems within the same sole of the footwear, or one or more compression bellows, or one or more admission, retaining or flush valves, and one or more expansion bellows.

BRIEF DESCRIPTION OF THE DRAWINGS

In order to make the object of the invention easier to understand, the invention is illustrated with 6 figures, which are used as a demonstrative example, being.

DETAILED DESCRIPTION OF THE PREFERRED EMBODIMENT

As shown on FIGS. 1 to 6, the invention comprises seven elements: the compression bellows (A), the compressed air (or any other type of compressed gas) retainer (B), the expansion bellows (C), the air (or any other gaseous element) admission valve (M), the aft retaining valve (K), the fore retaining valve (P) and the flush or exhaust valve (T).

Figure 1:
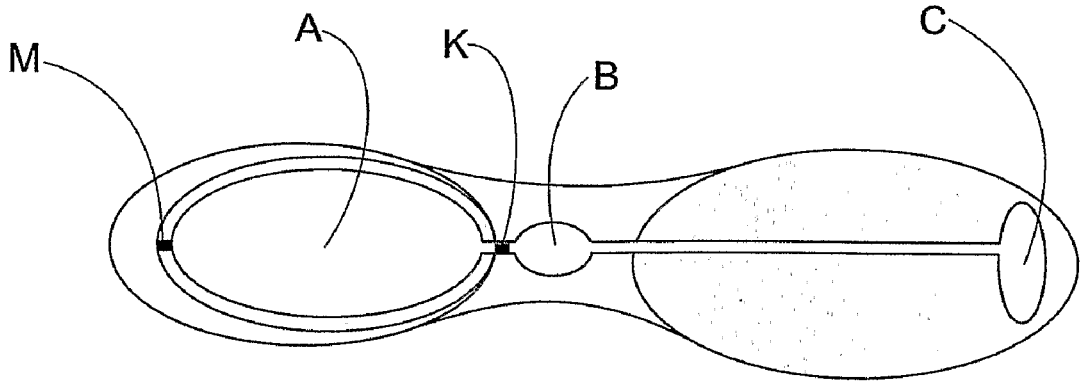
FIG. 1 a top section view of the sole of the footwear, showing the open system.
Figure 2:
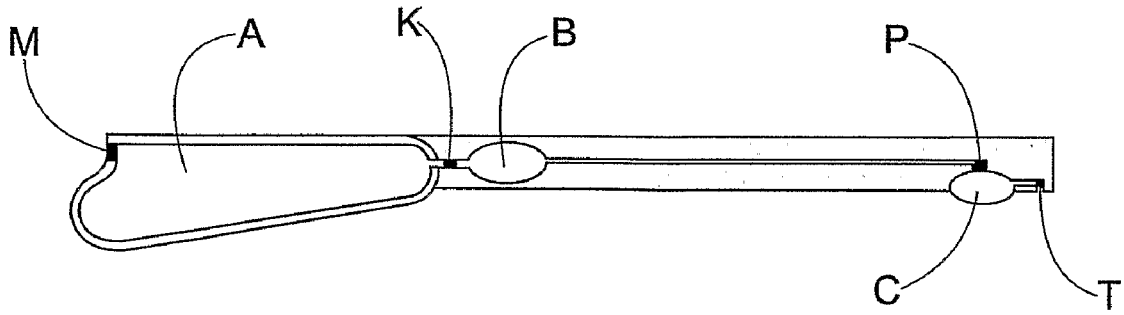
FIG. 2 a side section view of the sole of the footwear, showing open system.
Figure 3:
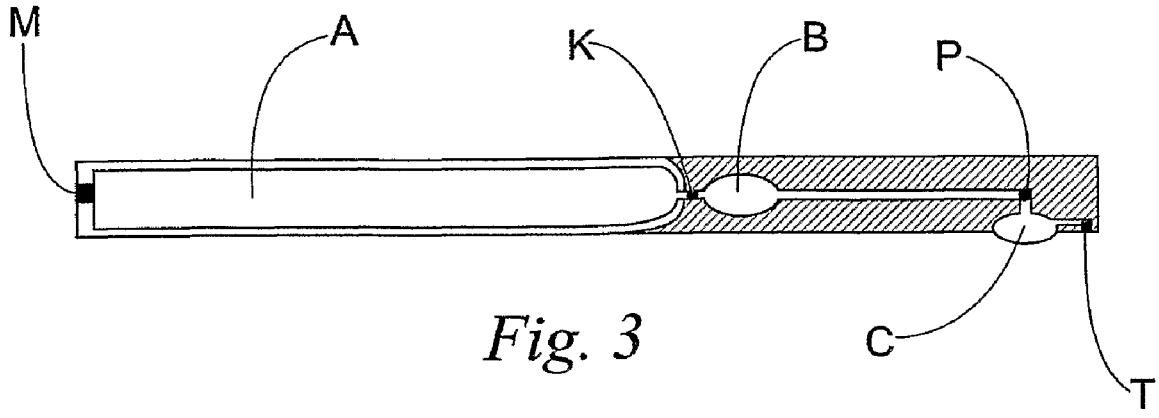
FIG. 3 a side section view of the sole of the footwear, but in an embodiment different from the one shown on FIGS. 1 and 2, showing the open system.
Figure 4:
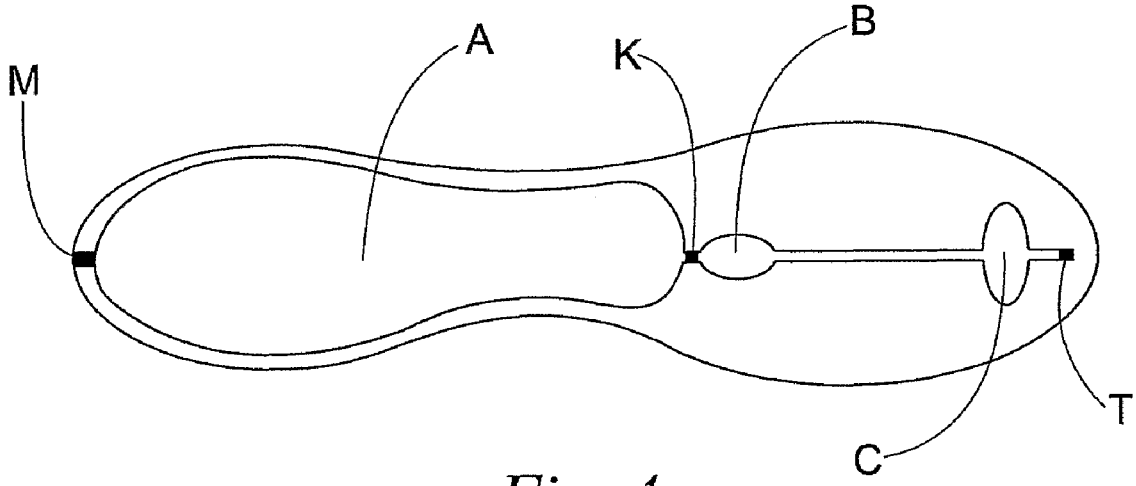
FIG. 4 a top section view of the sole of the footwear, but in an embodiment different from the one shown on FIGS. 1 and 2, showing the open system.
Figure 5:
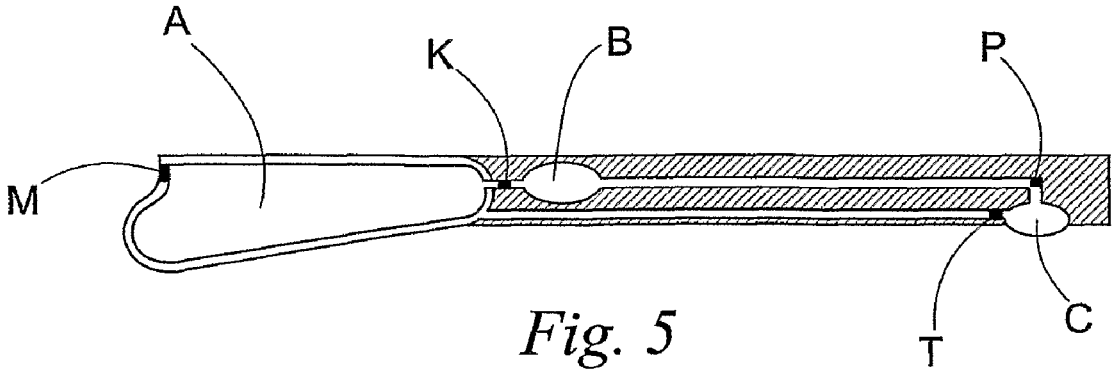
FIG. 5 a side section view of the sole of the footwear, showing the closed system.
Figure 6:
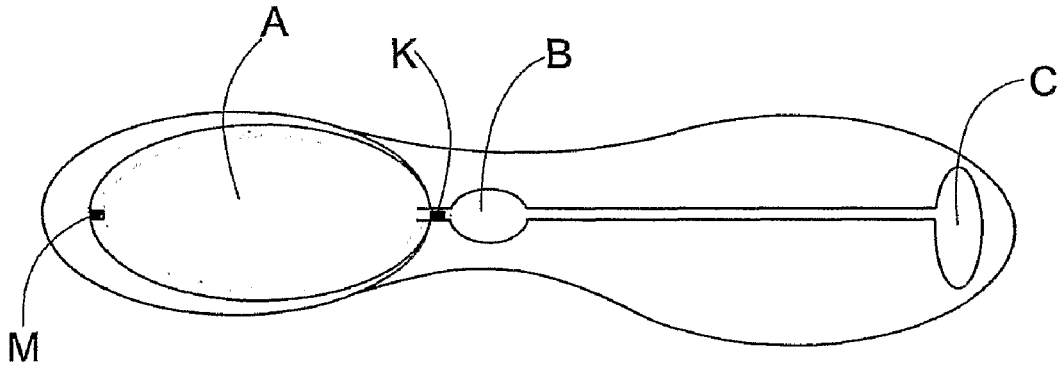
FIG. 6 a top section view of the sole of the footwear, showing the closed system.

In order to better understand the invention, reference is made to FIG. 1 which shows the profile of the sole of a footwear on a top section view and FIG. 2 which shows the same profile on a side section view, a said sole comprises, on its aft portion, a compression bellows (A) which, on its turn, comprises on its fore end a valve (M) of admission of air (or any other gaseous element) and on the front end of the same compression bellows (A) there is an aft retaining valve (K), which through a small duct flows into a retainer (B) of compressed air (or any type of compressed gas), flowing into, through another duct, the expansion bellows (C) that comprises a fore retaining valve (P) driven by pressure, and the same expansion bellows (C) comprises, on its fore end, a flush or exhaust valve (T) driven by pressure release. Even though the present invention is described in detail, it is important to understand that is not limited in application to the details and parts herein described. The invention is capable of having other embodiments and of being carried out with one or more parallel systems within the same sole of footwear, or one or more compression bellows, or one or more admission, retaking or flush valves, and/or one or more expansion bellows, and, therefore, it can be carried out in several different embodiments. One must understand that the terminology used in the present patent description has only an illustrative purpose, not limiting the scope to the present invention.

Having described and specified the nature and scope of the invention and its preferred embodiment, the following claims are made of exclusive rights and property.

The invention claimed is:

1. A device for utilization of energy generated by a body weight comprising:

a sole of a flexible piece of a footwear, wherein the sole comprises a front section, a back section, and a middle section;

a compression bellow (A) located in the front section of the sole, the compression bellow including a first end and a second end;

a gaseous element admission valve (M) located in the first end of the compression bellow, wherein the gaseous admission valve admits a gaseous material into the compression bellow;

a gaseous retaining valve (K) located in the second end the compression bellow;

a retainer (B) located in the middle section of the sole;

a first duct to flow the gaseous material from the compression bellow to the retainer (B);

an expansion bellow (C) located in the back section of the sole, the compression bellow including a first end and a second end;

a second duct located in the first end of the expansion bellow, wherein the second duct flows the gaseous material from the retainer (B) to the expansion bellow (C);

a pressure driving retaining valve (P) located on the expansion below;

a flush valve (T) located on the second end of the expansion bellow, wherein the flush valve is driven by the release of the pressure;

wherein through the body weight on the back section of the sole the gaseous material is compress, the compression bellow (A) delivers the gaseous material to the retainer (B), retaining it therein through the gaseous retaining valve (K) and the pressure driving retaining valve (P), and displacing the body weight on the front section of the sole, drives the pressure driving retaining valve (P) of the retainer, releasing the compressed gas into the expansion bellow(C), expanding the expansion bellow (C), producing an expulsion force, forcing the opening of the flush valve (T), releasing the compressed gas and completing the cycle.

2. A device for utilization of energy generated by a body weight according to claim 1 wherein the size of the compression bellow (A) is always larger than the size of the retainer (B) and the size of the expansion bellow (C).

3. A device for utilization of energy generated by a body weight according to claim 1 wherein the size of the retainer (B) is always smaller than or as large as the expansion bellow (C).

4. A device for utilization of energy generated by a body weight comprising:

a sole of a flexible piece of a footwear, wherein the sole comprises a front section, a back section, and a middle section;

a compression bellow (A) located in the front section of the sole, the compression bellow including a first end and a second end;

a gaseous element admission valve (M) located in the first end of the compression bellow, wherein the gaseous admission valve admits a gaseous material into the compression bellow;

a gaseous retaining valve (K) located in the second end the compression bellow;

a retainer (B) located in the middle section of the sole;

a first duct to flow the gaseous material from the compression bellow to the retainer (B);

an expansion bellow (C) located in the back section of the sole, the compression bellow including a first end and a second end;

a second duct located in the first end of the expansion bellow, wherein the second duct flows the gaseous material from the retainer (B) to the expansion bellow (C);

a pressure driving retaining valve (P) located on the expansion below;

a flush valve (T) located on the second end of the expansion bellow, wherein the flush valve is driven by the release of the pressure;

a membrane working as a filter on the air admission valve (M) and on the flush valve (T), wherein the membrane allows the passage only of the gaseous material blocking the passage of non-gaseous material.

* * * * *